US009090073B2

(12) United States Patent
Tamaki

(10) Patent No.: US 9,090,073 B2
(45) Date of Patent: Jul. 28, 2015

(54) LIQUID EJECTION APPARATUS

(75) Inventor: Shuichi Tamaki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 359 days.

(21) Appl. No.: 13/433,262

(22) Filed: Mar. 28, 2012

(65) Prior Publication Data

US 2013/0083138 A1 Apr. 4, 2013

(30) Foreign Application Priority Data

Sep. 30, 2011 (JP) ..... 2011-218716

(51) Int. Cl.
*B41J 2/175* (2006.01)
*B41J 29/02* (2006.01)

(52) U.S. Cl.
CPC . *B41J 2/175* (2013.01); *B41J 29/02* (2013.01)

(58) Field of Classification Search
USPC ..... 347/84–86, 104–108
See application file for complete search history.

(56) References Cited

U.S. PATENT DOCUMENTS

| | | | | |
|---|---|---|---|---|
| 6,494,568 | B2 * | 12/2002 | Hou et al. | 347/86 |
| 6,726,315 | B2 * | 4/2004 | Koizumi et al. | 347/85 |
| 7,931,357 | B2 * | 4/2011 | Umeda | 347/85 |
| 7,963,641 | B2 * | 6/2011 | Umeda | 347/85 |
| 8,057,022 | B2 * | 11/2011 | Umeda | 347/85 |
| 2003/0025773 | A1 * | 2/2003 | Koizumi et al. | 347/85 |
| 2006/0262169 | A1 * | 11/2006 | Umeda | 347/85 |
| 2008/0174645 | A1 * | 7/2008 | Umeda et al. | 347/92 |
| 2008/0239028 | A1 * | 10/2008 | Umeda | 347/85 |
| 2009/0040254 | A1 * | 2/2009 | Umeda | 347/12 |

FOREIGN PATENT DOCUMENTS

| | | | | |
|---|---|---|---|---|
| JP | 2002292895 | A | 10/2002 | |
| JP | 2004-209662 | A | 7/2004 | |
| JP | 2004-216599 | A | 8/2004 | |
| JP | 2005-022340 | A | 1/2005 | |
| JP | 2005-081546 | A | 3/2005 | |
| JP | 2005081546 | A * | 3/2005 | B41J 2/175 |

OTHER PUBLICATIONS

Japanese Office Action issued in related Japanese application No. 2011-218716, mailed Mar. 3, 2015.

* cited by examiner

*Primary Examiner* — Matthew Luu
*Assistant Examiner* — Lily Kemathe
(74) *Attorney, Agent, or Firm* — Merchant & Gould PC

(57) ABSTRACT

A liquid ejection apparatus includes a recording unit which ejects liquid to record an image, a tank having a storage chamber which stores liquid for the recording unit and a communication port which allows the liquid storage chamber to communicate with atmosphere, a first housing, and a second housing which holds the recording unit and the tank and is rotatable about an axis line relative to the first housing between a close position where the recording unit comes close to the first housing and a separate position where the recording unit is separated from the first housing. An upper surface of the storage chamber has two regions divided by an imaginary plane to have same area, which is parallel with the axis line and intersects with the upper surface, and the communication port is provided in a region of the two regions, which is away from the axis line.

12 Claims, 11 Drawing Sheets

LIQUID EJECTION APPARATUS

CROSS-REFERENCE TO RELATED APPLICATION

This application claims priority from Japanese Patent Application No. 2011-218716, filed on Sep. 30, 2011, the entire subject matter of which is incorporated herein by reference.

TECHNICAL FIELD

Aspects of the present invention relate to a liquid ejection apparatus having a liquid ejection head which ejects liquid from an ejection port.

BACKGROUND

There has been known an inkjet printer including: an upper housing having a recording head which ejects ink on a sheet and thus records an image on the sheet, and a sub-tank which supplies ink to the recording head; and a lower housing having a sheet conveyance mechanism. In the inkjet printer, the upper housing is provided rotatably with respect to the lower housing so as to easily perform a maintenance operation.

In some cases, the sub-tank is formed with an atmosphere communication port which allows a liquid storage chamber storing the liquid and the atmosphere to communicate with each other so as to stabilize an ink meniscus formed in an ejection port. In this case, when rotating the upper housing, the sub-tank is inclined, so that the stored ink might be leaked to the outside through the atmosphere communication port. The ink leaked to the outside cannot be used to form an image, so that the ink is wasted.

SUMMARY

Accordingly, it is an aspect of the present invention to provide a liquid ejection apparatus capable of preventing liquid from being leaked to an outside even when a tank which stores liquid to be supplied to a recording head is inclined.

According to an illustrative embodiment of the present invention, there is provided a liquid ejection apparatus including a support unit, a recording unit, a tank, a first housing, and a second housing. The support unit is configured to support a recording medium. The recording unit has an ejection port for ejecting liquid to record an image on the recording medium supported on the support unit. The tank includes a liquid storage chamber configured to store liquid to be supplied to the recording unit, and an atmosphere communication port configured to allow the liquid storage chamber and atmosphere to communicate with each other. The first housing is configured to hold the support unit. The second housing is configured to hold the recording unit and the tank. The second housing is configured to be rotatable about a predetermined axis line with respect to the first housing to be moved between a close position where the recording unit comes close to the first housing and faces the support unit and a separate position where the recording unit is separated from the first housing than the close position. An upper surface of the liquid storage chamber includes two regions divided by a first imaginary plane to have same area, which is parallel with the axis line and intersects with the upper surface, and the atmosphere communication port is provided in a region of the two regions, which is away from the axis line.

According to the above configuration, the upper surface of the liquid storage chamber includes two regions divided by the first imaginary plane to have same area, which is parallel with the axis line and intersects with the upper surface, and the atmosphere communication port is located in a region of the two regions, which is away from the axis line. Therefore, even though the tank is inclined when the second housing is moved from the close position to the separate position, it is possible to suppress a liquid level of the liquid stored in the liquid storage chamber from contacting the atmosphere communication port. Thereby, it is possible to prevent the liquid stored in the tank from being leaked to the outside.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, illustrative embodiments of the present invention will be described with reference to the drawings.

Figure 1:
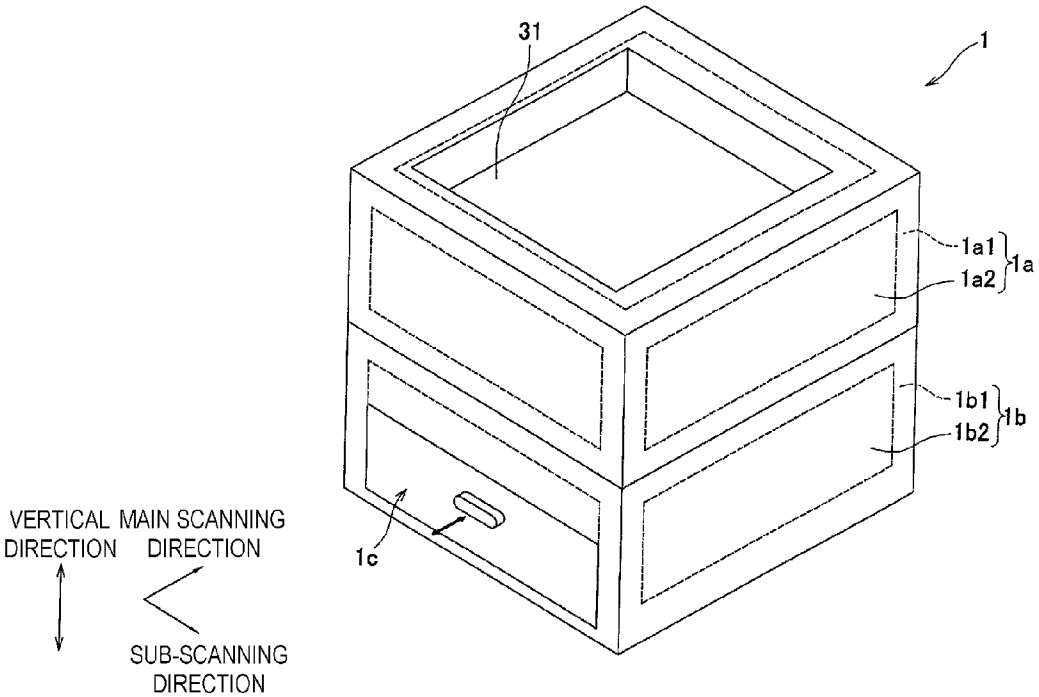
FIG. 1 is a perspective view showing an outer appearance of an inkjet printer according to an illustrative embodiment of the present invention.

First, an overall configuration of an inkjet printer 1 (an example of a liquid ejection apparatus) is described with reference to FIGS. 1 to 3.

The printer 1 has an upper housing (second housing) 1*a* and a lower housing (first housing) 1*b*, both of which have a rectangular parallelepiped shape and the substantially same size. The upper housing 1*a* has an opened lower surface and the lower housing 1*b* has an opened upper surface. The upper housing 1*a* has a frame 1*a*1 and an outer cover 1*a*2 which covers an outer side of the frame 1*a*1. The lower housing 1*b* also has a frame 1*b*1 and an outer cover 1*b*2 which covers an outer side of the frame 1*b*1. The upper housing 1*a* overlaps with the lower housing 1*b* and the opened surfaces thereof match each other, so that an interior space of the printer 1 is defined (refer to FIG. 2). An upper part of a top plate of the upper housing 1*a* is provided with a sheet discharge part 31. A sheet conveyance path in which a sheet P is conveyed from a feeder unit 1*c* (which will be described later) toward the sheet discharge part 31 along a thick arrow shown in FIG. 2 is formed in the space defined by the upper and lower housings 1*a*, 1*b*.

Figure 2:
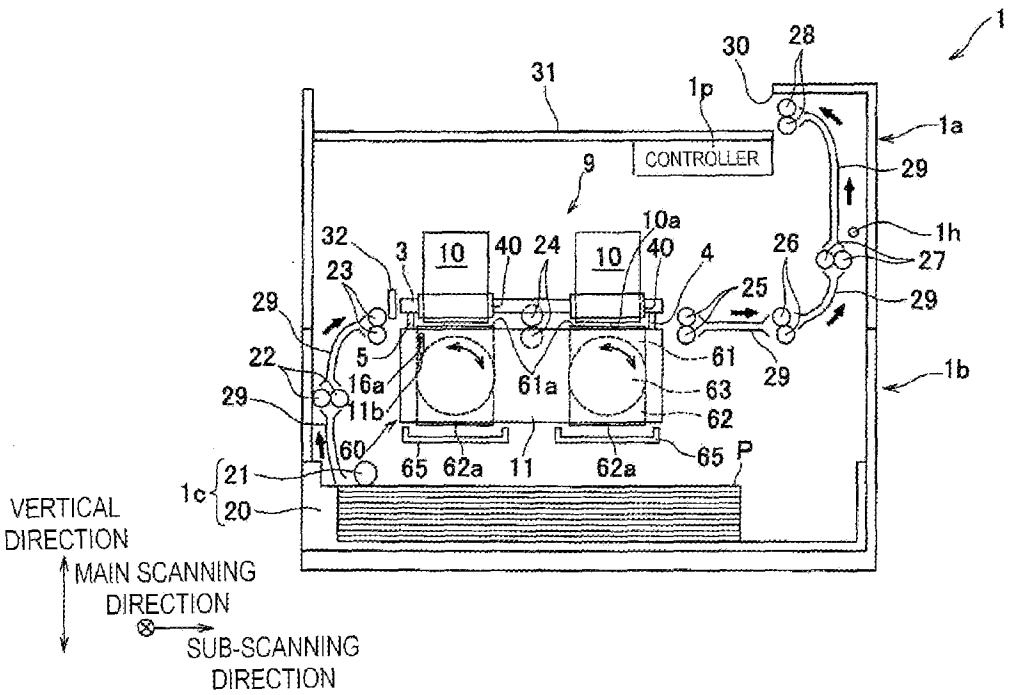
FIG. 2 is a schematic side view showing an interior of the printer shown in FIG. 1.
Figure 3:
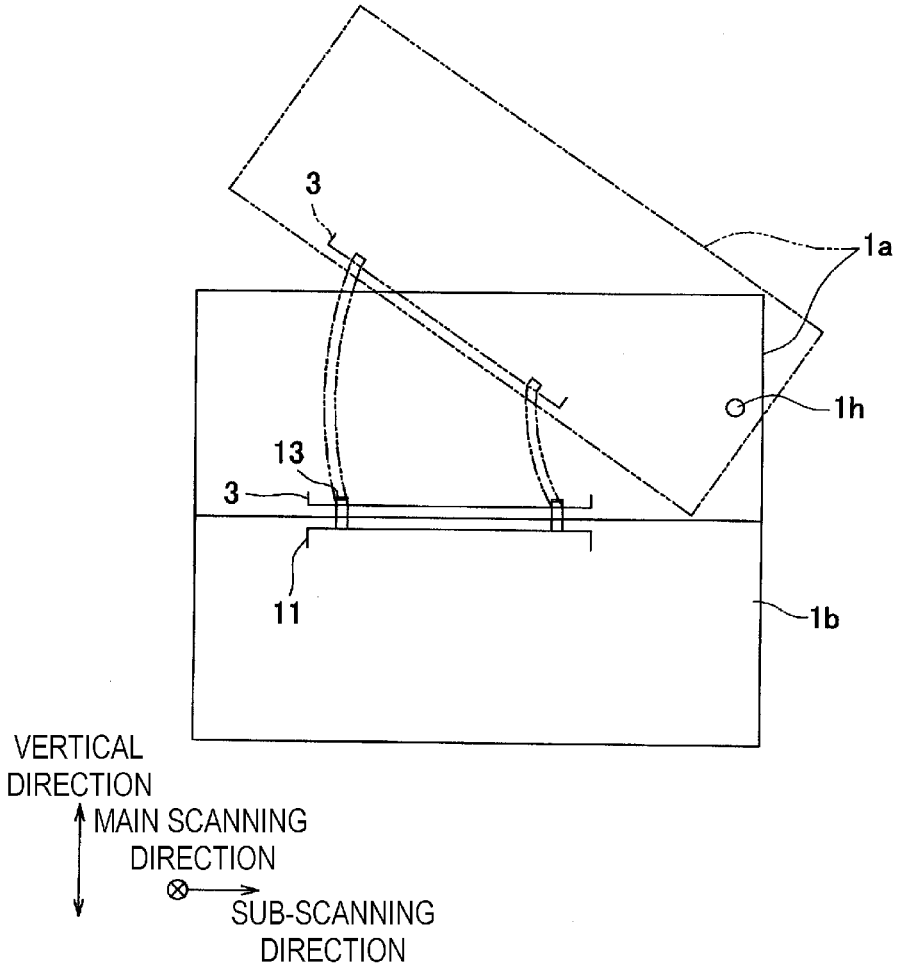
FIG. 3 illustrates a state where an upper housing shown in FIG. 2 is rotated.

As shown in FIGS. 2 and 3, the upper housing 1*a* is coupled to the lower housing 1*b* via a shaft 1*h* which extends in a main scanning direction at a substantial center (in a vertical direction) of one end portion (right end portion in the drawings) of the upper housing 1*a* in a sub-scanning direction. The upper housing 1*a* is rotatable with respect to the lower housing 1*b* about the shaft 1*h*. The upper housing 1*a* is rotated to be moved between a close position (a position shown in FIG. 2 and a position shown with the solid line in FIG. 3) which is close to the lower housing 1*b* and a separate position (a position shown with the dashed-two dotted line in FIG. 3) which is separated away from the lower housing 1*b* than that of the close position. When the upper housing 1*a* is located at the separate position, a part of the sheet conveyance path, which is formed by the upper housing 1*a* in the close position and the lower housing 1*b*, is exposed to the outside, so that a user's operation space is provided in the sheet conveyance path. When the upper housing 1*a* is located at the separate position and the operation space is thus provided, the user can remove a jammed sheet P in the sheet conveyance path or perform a maintenance operation on a recording unit 9 or a support unit 60. The maintenance operation of the recording unit 9 or the support unit 60 is an operation of removing foreign matters attached on an ejection surface 10*a*, a support surface 61*a* and a facing surface 62*a*, for example. The shaft 1*h* is provided with a spring (not shown) which urges the upper housing 1*a* in an opening direction (from the close position toward the separate position). In this illustrative embodiment, the upper housing 1*a* can be opened up to an inclination angle of about 35 degrees with respect to a horizontal surface. In the meantime, in the printer 1, a left surface of FIG. 3 is a front face and an opposite surface to the front surface is a rear face.

The upper housing 1*a* accommodates therein two heads 10 (a pre-coat head 10 which ejects pre-processing liquid and an inkjet head 10 which ejects black ink, in order from an upstream side of the sheet conveyance direction shown with the thick arrow in FIG. 2), a frame 3 which supports the two heads 10 and an upper roller of a pair of conveyance rollers 24, a head lifting mechanism (not shown) which lifts the frame 3 up and down along a vertical direction, two cartridges (not shown) corresponding to the heads 10 and a controller 1*p* which controls operations of respective units of the printer 1. In this illustrative embodiment, the two heads 10 and frame 3 configure the recording unit 9 which records an image on the sheet P. The recording unit 9 is held at the upper housing 1*a* via the head lifting mechanism.

Also, the upper housing 1*a* accommodates therein upper rollers of conveyance roller pairs 25, 26, an upper guide of guides 29 between the roller pairs 25, 26, conveyance roller pairs 27, 28 and two sets of guides 29 between the conveyance roller pairs 26, 28 along the sheet conveyance direction. That is, when the upper housing 1*a* is rotated from the close position to the separate position, all the above accommodated parts are moved together with the upper housing 1*a*.

The lower housing 1*b* accommodates (holds) the support unit 60, a wiper unit, two waste liquid trays 65 and the feeder unit 1*c*. Further, the lower housing 1*b* also accommodates therein a sheet sensor 32, conveyance roller pairs 22, 23 and two sets of guides 29 between the feeder unit 1*c* and the pair of conveyance rollers 23 along the sheet conveyance direction.

Each cartridge stores the pre-processing liquid or black ink (hereinafter, collectively referred to as 'liquid') which is supplied to the corresponding head 10 via a liquid supply mechanism (not shown). The pre-processing liquid is liquid having a function of preventing the ink from bleeding or exuding back, a function of improving color expression property or quick-drying of the ink and the like. The respective cartridges are connected to the heads 10 via sub-tanks 51*a*, 51*b*. The sub-tanks 51*a*, 51*b* are provided to form a negative pressure in flow paths of the heads 10 so as to stabilize menisci formed in ejection ports of the heads 10 when recording an image. The liquids in the sub-tanks 51*a*, 51*b* are automatically supplied to the heads 10.

Each head 10 is a line type which is long in the main scanning direction and has a substantially rectangular parallelepiped shape. The two heads 10 are separated from each other in the sub-scanning direction and are supported to the frame 3. The respective heads 10 are provided on upper surfaces thereof with joints, to which other ends of tubes (not shown) having one ends connected to the sub-tanks 51*a*, 51*b* are attached, and on lower ejection surfaces 10*a* with a plurality of opened ejection ports, and are formed therein with flow paths along which the liquids supplied from the sub-tanks 51*a*, 51*b* reach the ejection ports. The frame 3 is provided with annular members 40 each of which surrounds a lower end periphery of each head 10.

The head lifting mechanism lifts the frame 3 up and down in the vertical direction when the upper housing 1*a* is located at the close position, thereby moving the two heads 10 between a recording position and a retraction position. At the recording position, the two heads 10 face the support unit 10 at an interval which is appropriate for recording. Under control of the controller 1*p*, the head lifting mechanism is controlled such that the heads 10 are provided at the appropriate recording position, depending on types of the sheet P.

The feeder unit 1*c* has a sheet feeding tray 20 and a sheet feeding roller 21. The sheet feeding tray 20 is detachably mounted to the lower housing 1*b* in the sub-scanning direction. The sheet feeding tray 20 is a box which is opened upward and can accommodate therein sheets P having various sizes. The sheet feeding roller 21 is rotated under control of the controller 1*p* and feeds the uppermost sheet P in the sheet feeding tray 20. The sheet P fed by the sheet feeding roller 21 is guided by the guides 29, sequentially held by the conveyance roller pairs 22, 23 and then sent to the support unit 60.

The support unit 60 is provided to face the recording unit 9 in the vertical direction. The support unit 60 has two rotary members 63 which face the heads 10, respectively, two platens 61 and two facing members (facing parts) 62 which are fixed on circumferential surfaces of the rotary members 63 and a frame 11 which rotatably supports the two rotary members 63. The rotary member 63 has a shaft in the main scanning direction and is rotated about the shaft under control of the controller 1*p*. Also, the frame 11 rotatably supports the lower conveyance roller 24.

The platen 61 and the facing member 62 have larger sizes than the ejection surface 10*a* in the main scanning direction and in the sub-scanning direction, and are provided to face each other in the vertical direction.

The platen 61 has a support surface 61*a* which faces the ejection surface 10*a* and supports the sheet P and is made by material and processed to keep the sheet P. For example, a weak adhesive silicon layer is formed or a plurality of ribs is formed on the support surface 61*a* along the sub-scanning direction, so that the sheet P put on the support surface 61*a* is prevented from floating. The platen 61 is made of resin.

Figure 4A:
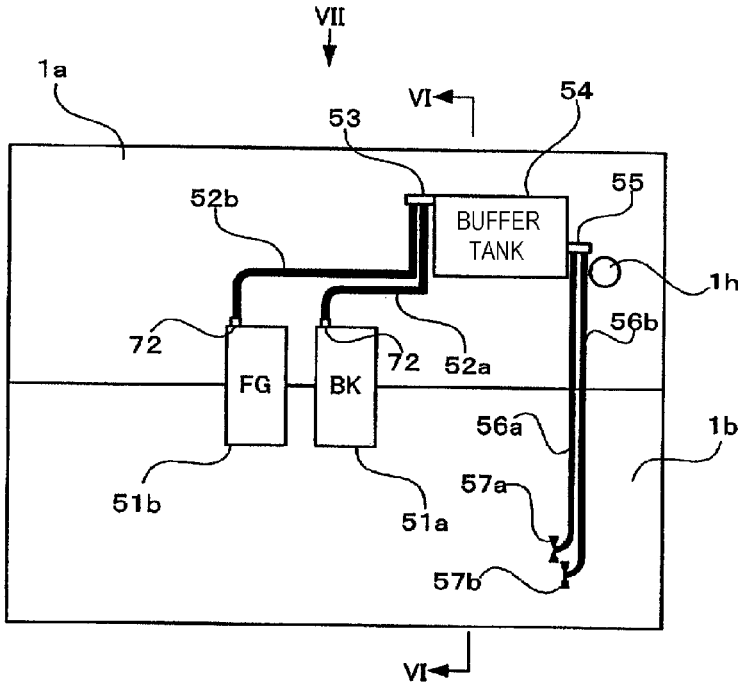
FIGS. 4A and 4B are schematic side views of an atmosphere communication mechanism to an inkjet head shown in FIG. 2.
Figure 4B:
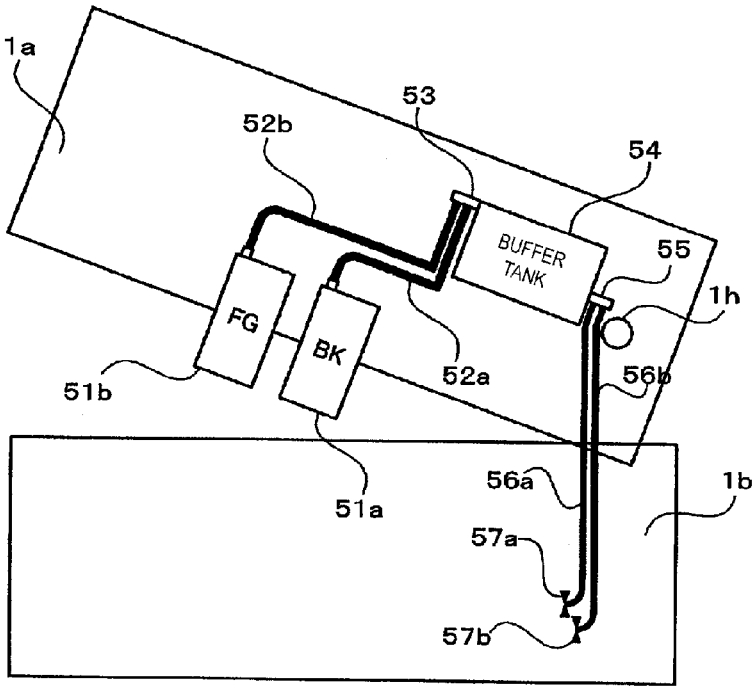

As shown in FIGS. 4A and 4B, an atmosphere communication mechanism is fixed to the upper housing 1*a*. The atmosphere communication mechanism includes the sub-tanks

51*a*, 51*b* having liquid storage chambers 71, communication tubes 52*a*, 52*b*, a buffer tank 54 and communication tubes 56*a*, 56*b*. The sub-tanks 51*a*, 51*b* are provided in the vicinity of the left side surface of the upper housing 1*a* (refer to FIG. 6). The sub-tanks 51*a*, 51*b* have the liquid storage chambers 71. The liquid storage chambers 71 have atmosphere communication ports 72 which allow the interior spaces thereof and the atmosphere to communicate with each other. The liquid storage chamber 71 of the sub-tank 51*a* stores black ink, and the liquid storage chamber 71 of the sub-tank 51*b* stores the pre-processing liquid. The liquids stored in the sub-tanks 51*a*, 51*b* are supplied to the heads 10. Specifically, the controller (an example of a storage amount control unit) 1*p* controls a pump such that the liquids are introduced into the liquid storage chambers 71 from the cartridges until liquid levels, which are detected by liquid-level sensors (not shown) provided to the sub-tanks 51*a*, 51*b*, reach predetermined positions. A storage amount of the liquid storage chamber 71 becomes a maximum when the liquid level reaches the predetermined position. In the meantime, the controller 1*p* may perform control of opening and closing valves which are provided in liquid introduction paths of the liquid supply mechanism from the cartridges to the liquid storage chambers 71.

Figure 5:
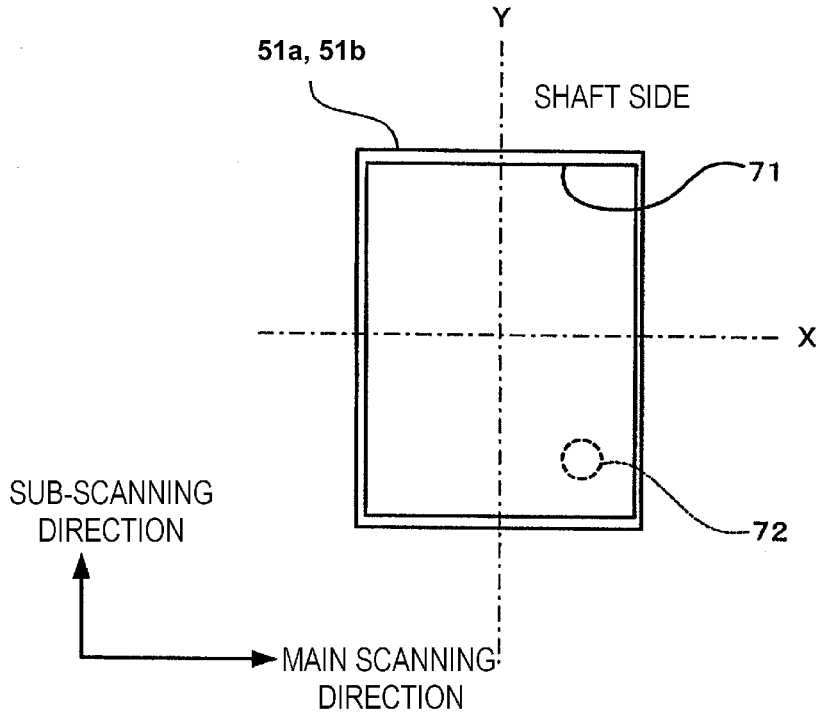
FIG. 5 is a sectional view seen from a horizontal plane of a sub-tank shown in FIGS. 4A and 4B.

As shown in FIG. 5, when dividing an upper surface of the liquid storage chamber 71 into two regions having the same area by an imaginary plane X which is parallel with the shaft 1*h* (axis line), i.e., the main scanning direction and intersects with the upper surface, the atmosphere communication port 72 is located in one region of the two regions, which is away from the shaft 1*h*. In other words, the upper surface of the liquid storage chamber 71 includes two regions divided by the imaginary plane X to have same area, and the atmosphere communication port 72 is located in one region of the two regions, which is away from the shaft 1*h*. Also, when further dividing the region into two sections having the same area by an imaginary plane Y which is parallel with the sub-scanning direction and intersects with the upper surface, the atmosphere communication port 72 is located in one section of the two sections, which is closer to the buffer tank 54 (refer to FIG. 6). In other words, the region in the upper surface, which includes the atmosphere communication port, includes two sections divided by the imaginary plane Y to have same area, and the atmosphere communication port 72 is located in one section of the two sections, which is closer to the buffer tank 54. Further, the atmosphere communication port 72 is provided such that the stored liquid does not reach the port even though the sub-tanks 51*a*, 51*b* are inclined when the upper housing 1*a* is rotated from the close position about the shaft 1*h* by a maximum amount in a case where a liquid storage amount in the liquid storage chamber 71 is a predetermined amount which is the maximum storage amount. Accordingly, the liquid which is stored in the liquid storage chamber 71 is not leaked from the atmosphere communication port 72.

The buffer tank (liquid holding chamber) 54 is provided at an upper position than the sub-tanks 51*a*, 51*b* at the time when the upper housing 1*a* is provided at the close position and has a pair of discharge flow paths which accommodate a sponge (absorption member) 75 for holding the liquid. The buffer tank 54 is connected with joints 53, 55. An upstream port (not shown) is formed at a boundary between the joint 53 and the buffer tank 54 and a downstream port (not shown) is formed between the joint 55 and the buffer tank 54. The upstream port and downstream port are configured such that the upstream port of each discharge flow path is located at an upper position than the downstream port thereof by the joints 53, 55 when the upper housing 1*a* is located at the close position. At this time, the joints 53, 55, i.e., the upstream port and the downstream ports are located above the sponge 75. Also, a part of each discharge flow path, in which the sponge 75 is provided, has a larger flow path sectional area than the surrounding area thereof.

Figure 11:
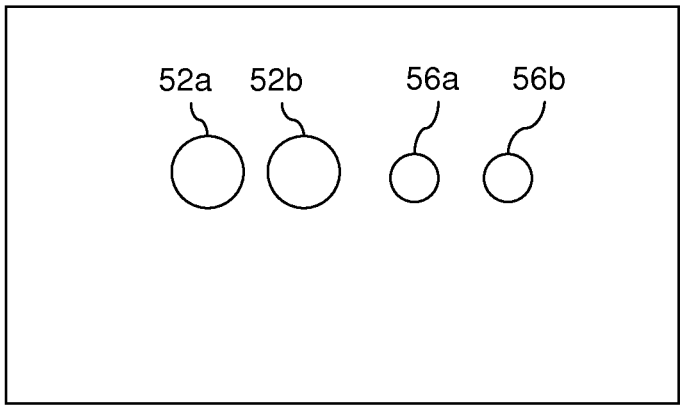
FIG. 11 shows a relationship between the flow path sectional areas of respective communication tubes.

The atmosphere communication ports 72 of the respective sub-tanks 51*a*, 51*b* are connected with one ends of the communication tubes 52*a*, 52*b*, respectively. The other ends of the communication tubes 52*a*, 52*b* are connected to the joint 53. The joint 55 is connected with one ends of the communication tubes 56*a*, 56*b*, respectively. The communication tubes 56*a*, 56*b* extend in a downward direction which is a direction separating away from the atmosphere communication ports 72 and valves 57*a*, 57*b* are respectively connected to end portions thereof. In the meantime, flow path sectional areas of the communication tubes 52*a*, 52*b* are larger than those of the communication tubes 56*a*, 56*b*, as depicted in FIG. 11.

Figure 6:
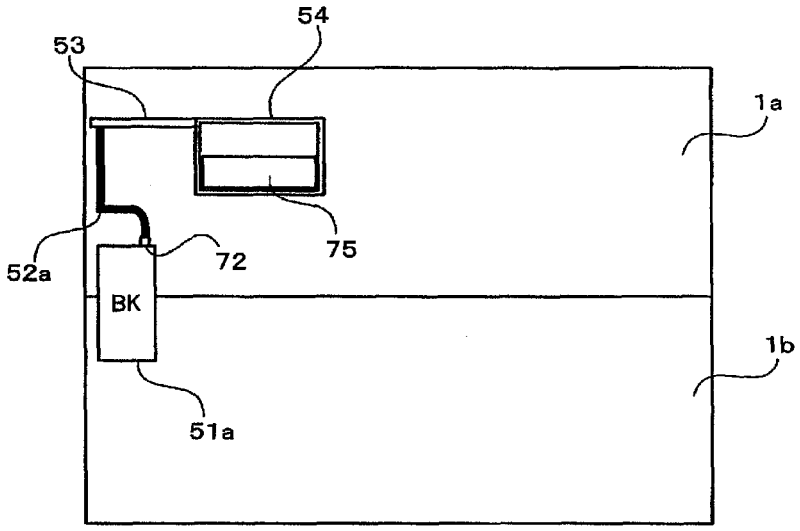
FIG. 6 is a sectional view taken along a line VI-VI of FIG. 4A.
Figure 7:
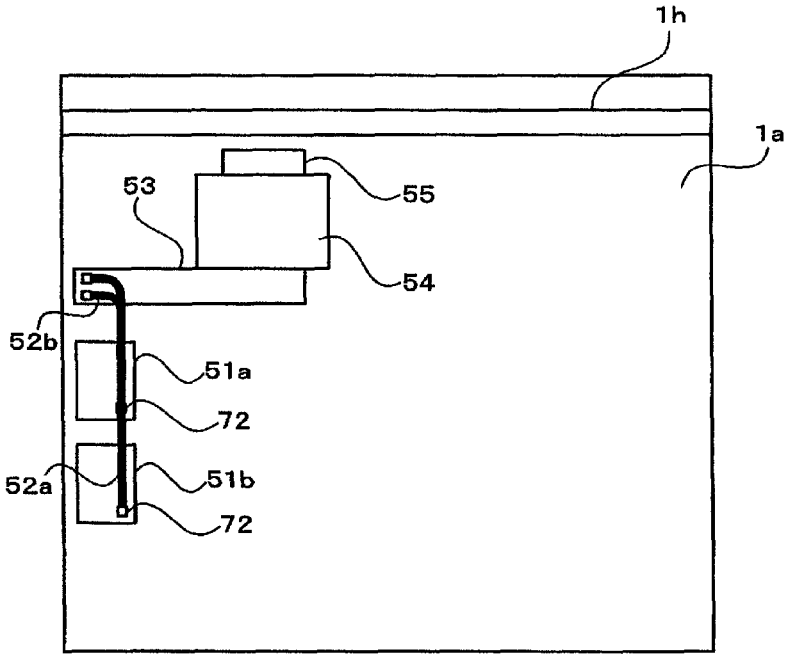
FIG. 7 is a view seen from an arrow VII of FIG. 4A.

As shown in FIGS. 6 and 7, in the state where the upper housing 1*a* is provided at the close position, the communication tubes 52*a*, 52*b* extend upward from the atmosphere communication ports 72, are bent at a right angle and extend in a direction coming close to the shaft 1*h* such that the communication tubes have components orthogonal to the shaft 1*h* as separating away from the atmosphere communication ports 72. Also, the communication tubes 52*a*, 52*b* extend to have components parallel with the shaft 1*h*, are bent at a right angle, extend upward and are then connected to the joint 53.

That is, the communication tube 52*a*, one discharge flow path of the buffer tank 54 and the communication tube 56*a* configure an atmosphere communication flow path which allows the liquid storage chamber 71 and the atmosphere to communicate with each other via the atmosphere communication port 72 of the sub-tank 51*a*. And, the communication tube 52*b*, the other discharge flow path of the buffer tank 54 and the communication tube 56*b* configure an atmosphere communication flow path which allows the liquid storage chamber 71 and the atmosphere to communicate with each other via the atmosphere communication port 72 of the sub-tank 51*b*. Thereby, when the valves 57*a*, 57*b* are opened, the interiors of the liquid storage chambers 71 are made to be atmospheric pressure, so that the liquid supply to the heads 10 can be stabilized. In the meantime, when the printer 1 is under non-use state, the valves 57*a*, 57*b* are closed to prevent the liquids from being dried.

Figure 8A:
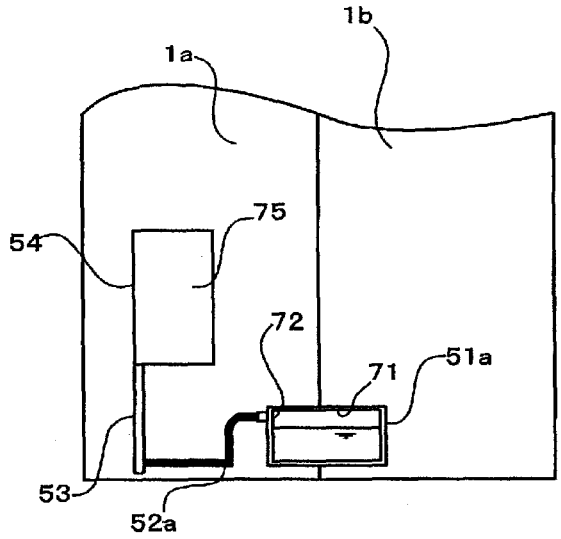
FIGS. 8A and 8B show the atmosphere communication mechanism when the printer is turned by 90° such that side surfaces become a bottom.
Figure 8B:
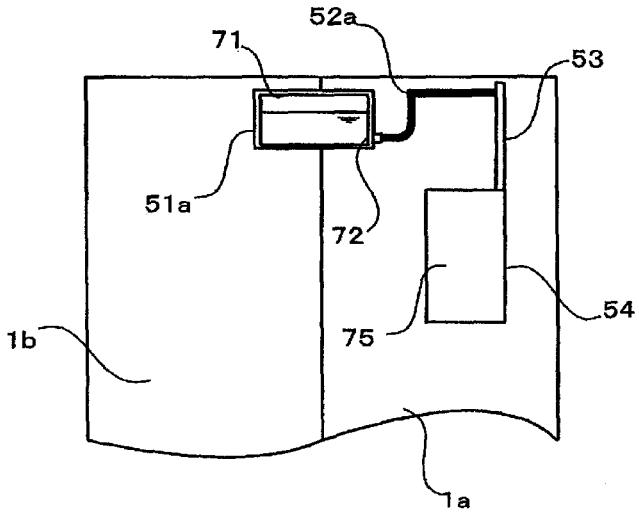
Figure 9A:
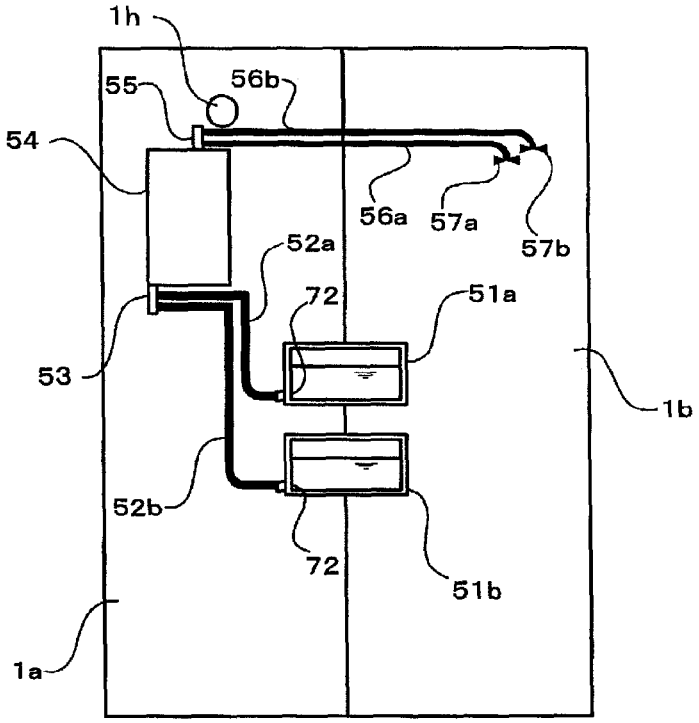
FIGS. 9A and 9B show the atmosphere communication mechanism when the printer is turned by 90° such that front and rear surfaces become a bottom.
Figure 9B:
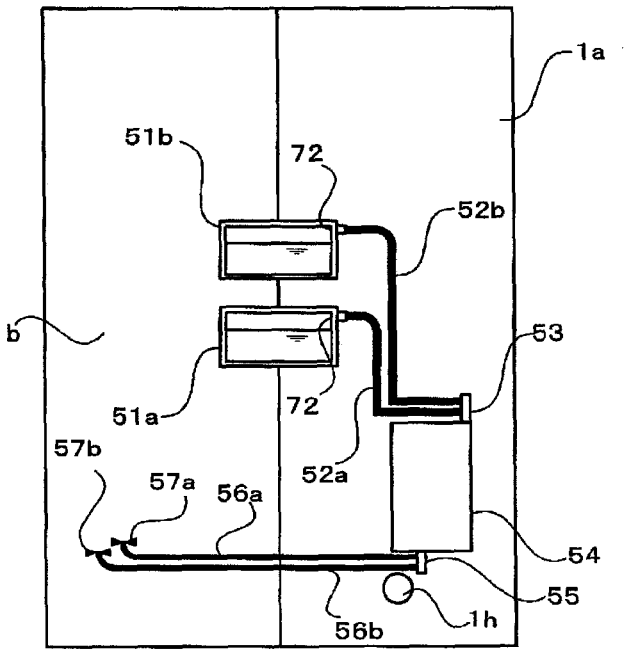
Figure 10:
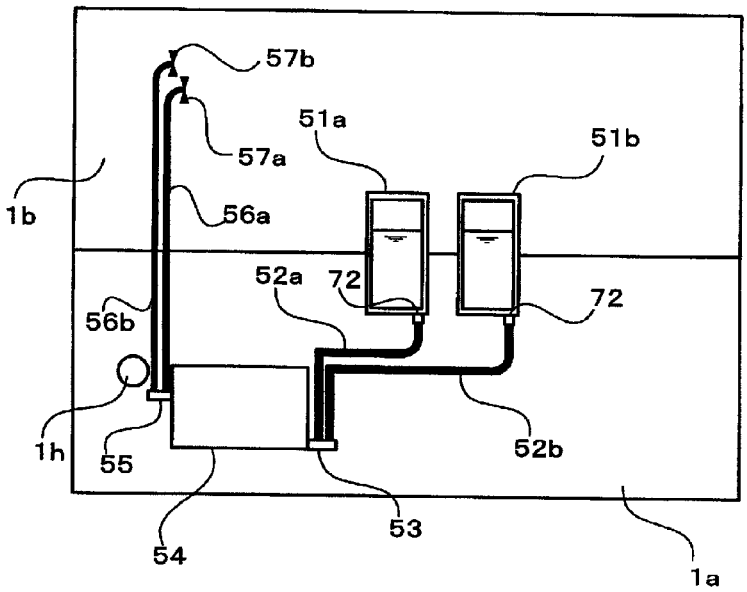
FIG. 10 shows the atmosphere communication mechanism when the printer is turned over by 180°.

In the below, the liquid state stored in the sub-tanks 51*a*, 51*b* when the printer 1 is turned over is described. FIG. 8A shows a state where the printer 1 is turned by 90° such that the left side surface becomes the bottom and FIG. 8B shows a state where the printer 1 is turned by 90° such that the right side surface becomes the bottom. FIG. 9A shows a state where the printer 1 is turned by 90° such that the front face becomes the bottom and FIG. 9B shows a state where the printer 1 is turned by 90° such that the rear face becomes the bottom. FIG. 10 shows a state where the printer 1 is turned over by 180°.

As shown in FIG. 8A, when the printer 1 is turned by 90° such that the shaft 1*h* becomes vertical and the left side surface becomes the bottom, the liquids which are stored in the liquid storage chambers 71 of the sub-tanks 51*a*, 51*b* are moved in the direction separating away from the atmosphere communication ports 72. Accordingly, the stored liquids are not leaked from the atmosphere communication ports 72.

As shown in FIG. 8B, when the printer 1 is turned by 90° such that the shaft 1*h* becomes vertical and the right side surface becomes the bottom, the liquids which are stored in the liquid storage chambers 71 of the sub-tanks 51*a*, 51*b* are moved in the direction coming close to the atmosphere communication ports 72. Accordingly, the liquids flow from the atmosphere communication ports 72 to the communication tubes 52*a*, 52*b*. At this time, the liquids having flown into the communication tubes 52*a*, 52*b* are stopped at positions of the parts extending in the upper-lower direction of the communication tubes 52*a*, 52*b* in FIG. 8B at heights which are flush with the liquid levels in the liquid storage chambers 71.

As shown in FIG. 9A, when the printer 1 is turned by 90° such that the shaft 1*h* is kept horizontal and the front face becomes the bottom, the liquids which are stored in the liquid storage chambers 71 of the sub-tanks 51*a*, 51*b* are moved in the direction coming close to the atmosphere communication ports 72. Accordingly, the liquids flow from the atmosphere communication ports 72 to the communication tubes 52*a*, 52*b*. At this time, the liquids having flown into the communication tubes 52*a*, 52*b* are stopped at positions of the parts (the components which are orthogonal to the shaft 1*h* as separating away from the atmosphere communication ports 72) extending in the upper-lower direction of the communication tubes 52*a*, 52*b* in FIG. 9A at heights which are flush with the liquid levels in the liquid storage chambers 71.

As shown in FIG. 9B, when the printer 1 is turned by 90° such that the shaft 1*h* is kept horizontal and the rear face becomes the bottom, the liquids which are stored in the liquid storage chambers 71 of the sub-tanks 51*a*, 51*b* are moved in the direction separating away from the atmosphere communication ports 72. Accordingly, the stored liquids are not leaked from the atmosphere communication ports 72.

As shown in FIG. 10, when the printer 1 is turned over by 180°, the liquids which are stored in the liquid storage chambers 71 of the sub-tanks 51*a*, 51*b* are moved in the direction coming close to the atmosphere communication ports 72. Accordingly, the liquids flow from the atmosphere communication ports 72 to the communication tubes 52*a*, 52*b*. At this time, the liquids having flown into the communication tubes 52*a*, 52*b* pass through the buffer tank 54 and are stopped at the positions of the parts extending in the upper-lower direction of the communication tubes 56*a*, 56*b* in FIG. 10 at heights which are flush with the liquid levels in the liquid storage chambers 71.

As described above, according to the printer 1 of the present illustrative embodiment, the upper surface of the liquid storage chamber 71 includes two regions divided by the imaginary plane X to have same area, which is parallel with the shaft 1*h* and intersects with the upper surface, and the atmosphere communication port 72 is located in one region of the two regions, which is away from the shaft 1*h*. Therefore, when the upper housing 1*a* is rotated from the close position about the shaft 1*h* by a maximum amount, even though the sub-tanks 51*a*, 51*b* are inclined, it is possible to suppress the liquid levels of the liquids stored in the liquid storage chambers 71 from contacting the atmosphere communication ports 72. In other words, the atmosphere communication ports 72 are located in the region of the two regions, which is away from the shaft 1*h*, so that it is possible to store the liquids in the liquid storage chambers 71 as much as possible without leaking the liquids from the atmosphere communication ports 72, compared to a configuration where the atmosphere communication ports 72 are located in the region of the two regions, which is close to the shaft 1*h*. Also, even when the printer 1 is turned over such that the shaft 1*h* is kept horizontal and the rear face becomes the bottom, it is possible to suppress the liquid levels of the liquids, which are stored in the liquid storage chambers 71, from contacting the atmosphere communication ports 72. Thereby, it is possible to prevent the liquids, which are stored in the sub-tanks 51*a*, 51*b*, from being leaked to the outside.

Also, the atmosphere communication port 72 is provided such that the stored liquid does not reach the port even though the sub-tanks 51*a*, 51*b* are inclined when the upper housing 1*a* is rotated from the close position about the shaft 1*h* by a maximum amount in a case where a liquid storage amount in the liquid storage chamber 71 is a predetermined amount. Thereby, it is possible to prevent the liquid from being leaked to the outside even at a state where there is a high possibility that the liquid will be leaked from the atmosphere communication port 72.

Also, the sub-tanks 51*a*, 51*b* are connected with the atmosphere communication flow paths which allow the liquid storage chambers 71 and the atmosphere to communicate to each other via the atmosphere communication ports 72. Accordingly, the liquid which is leaked from the atmosphere communication ports 72 flow into the atmosphere communication flow paths, so that it is possible to further prevent the liquid stored in the sub-tanks 51*a*, 51*b* from being leaked to the outside.

At this time, the flow path sectional areas of the communication tubes 52*a*, 52*b* located at the upstream side are larger than those of the communication tubes 56*a*, 56*b* located at the downstream side. Accordingly, the parts close to the atmosphere communication ports 72 have the relatively large sectional areas, so that it is possible to prevent the blockade due to liquid attachment, foreign matters and the like. Also, the parts, which are distant from the atmosphere communication ports 72, have the relatively small sectional areas, so that it is possible to prevent the liquid from being leaked to the outside.

Also, since the communication tubes 52*a*, 52*b* are bent, it is possible to effectively prevent the liquids stored in the sub-tanks 51*a*, 51*b* from being leaked to the outside.

Furthermore, at the state where the upper housing 1*a* is provided at the close position, the communication tubes 52*a*, 52*b* extend in the direction coming close to the shaft 1*h* such that the communication tubes have components orthogonal to the shaft 1*h* as separating away from the atmosphere communication ports 72. Therefore, even though the printer 1 is turned over such that the shaft 1*h* is kept horizontal and the front face becomes the bottom, the liquids are stopped at those components. Thereby, it is possible to more effectively prevent the liquids stored in the sub-tanks 51*a*, 51*b* from being leaked to the outside.

Furthermore, the atmosphere communication ports 72 are located in one section of the two sections dividing the region, which is close to the buffer tank 54. The communication tubes 52*a*, 52*b* have the parts which extend from one section toward the other section such that the communication tubes have components parallel with the shaft 1*h* as separating away from the atmosphere communication ports 72. Therefore, when the printer 1 is turned over, even though the atmosphere communication ports 72 are located in the relatively lower section (the printer 1 is turned by 90° such that the shaft 1*h* becomes vertical and the right side surface becomes the bottom), the liquids are stopped at the parts which are parallel with the shaft 1*h* and extend from one section toward the other section. As a result, it is possible to more effectively prevent the liquids stored in the sub-tanks 51*a*, 51*b* from being leaked to the outside. Also, when the atmosphere communication ports 72 are located in the relatively upper section due to the horizontal turnover (the printer 1 is turned by 90° such that the shaft 1*h* becomes vertical and the left side surface becomes the bottom), it is possible to suppress the liquid levels of the liquids stored in the liquid storage chambers from contacting the atmosphere communication ports 72.

Also, at the state where the upper housing 1*a* is provided at the close position, the atmosphere communication flow paths have the communication tubes 52*a*, 52*b*, which are located at the upper positions than the sub-tanks 51*a*, 51*b*, and the communication tubes 56*a*, 56*b*, which are directed downward as separating away from the atmosphere communication ports 72 at the more downstream side than the communication tubes 52*a*, 52*b*. Therefore, even when the printer 1 is turned upside down, the liquids are stopped at the communication tubes 52*a*, 52*b*. Hence, it is possible to prevent the liquids stored in the sub-tanks 51*a*, 51*b* from being leaked to the outside.

Furthermore, when the upper housing 1*a* is provided at the close position, the lower ends of the communication tubes 56*a*, 56*b* are located at the lower position than the sub-tanks 51*a*, 51*b*. Accordingly, when the printer 1 is turned upside down, it is possible to more securely prevent the liquids stored in the sub-tanks 51*a*, 51*b* from being leaked to the outside.

Also, the atmosphere communication flow paths have the buffer tank 54. Thereby, the liquids leaked from the sub-tanks 51*a*, 51*b* are kept in the sponge 75, so that it is possible to securely prevent the liquids stored in the sub-tanks 51*a*, 51*b* from being leaked to the outside.

Furthermore, when the upper housing 1*a* is provided at the close position, the upstream port and downstream port of the buffer tank 54 are located at the upper position than the sponge 75. Therefore, when the printer is turned over by 180°, the liquid is temporarily kept in the space of the buffer tank 54 close to the upstream port and downstream port. After that, when the printer is returned to the normal position, the liquid can be kept by the sponge 54. At this time, the upstream port is located at the upper position than the downstream port. Hence, when the printer is turned over by 180°, since it is difficult for the liquid, which is introduced from the upstream port, to flow out from the downstream port, it is possible to suppress the liquid from being leaked to the outside.

While the present invention has been shown and described with reference to certain illustrative embodiments thereof, it will be understood by those skilled in the art that various changes in form and details may be made therein without departing from the spirit and scope of the invention as defined by the appended claims.

For example, in the above illustrative embodiment, the atmosphere communication port 72 is provided such that the stored liquid does not reach the port when the upper housing 1*a* is rotated from the close position about the shaft 1*h* by a maximum amount in the case where the liquid storage amount in the liquid storage chamber 71 is the predetermined amount. However, the stored liquid may reach the atmosphere communication port 72 when the upper housing 1*a* is rotated by the maximum amount. Also in this case, the liquid which is leaked from the atmosphere communication port 72 is stopped in the atmosphere communication flow path, so that it is not leaked to the outside.

Further, in the above illustrative embodiment, the sub-tanks 51*a*, 51*b* are connected with the atmosphere communication flow paths which allow the liquid storage chambers 71 and the atmosphere to communicate with each other via the atmosphere communication ports 72. However, the atmosphere communication flow paths may not be provided.

Further, in the above illustrative embodiment, the flow path sectional areas of the communication tubes 52*a*, 52*b* located at the upstream side are larger than those of the communication tubes 56*a*, 56*b* located at the downstream side. However, the relation between the flow path sectional areas thereof may be arbitrary.

Further, in the above illustrative embodiment, the communication tubes 52*a*, 52*b* are bent. However, the communication tubes may not be bent.

Further, in the above illustrative embodiment, the communication tubes 52*a*, 52*b* extend in the direction coming close to the shaft 1*h* such that communication tubes have the components orthogonal to the shaft 1*h* as separating away from the atmosphere communication ports 72. However, the communication tubes may not have the components orthogonal to the shaft 1*h*.

Further, in the above illustrative embodiment, the atmosphere communication ports 72 are located in the section which is close to the buffer tank 54 and the communication tubes 52*a*, 52*b* extend to have the components parallel with the shaft 1*h* as separating away from the atmosphere communication ports 72. However, the atmosphere communication ports 72 may be located in the section which is distant from the buffer tank 54 and the communication tubes may not have the components parallel with the shaft 1*h*.

Further, in the above illustrative embodiment, the communication tubes 52*a*, 52*b* extend upward from the atmosphere communication ports 72, are bent at a right angle, extend in the direction coming close to the shaft 1*h* such that the communication tubes have the components orthogonal to the shaft 1*h* as separating away from the atmosphere communication ports 72 and then extend to have the components parallel with the shaft 1*h*. However, the positional relation between the components orthogonal to the shaft 1*h* and the components parallel with the shaft 1*h* may be reverse.

Further, in the above illustrative embodiment, when the upper housing 1*a* is provided at the close position, the communication tubes 52*a*, 52*b* are located at the upper position than the sub-tanks 51*a*, 51*b* and the communication tubes 56*a*, 56*b* at the more downstream side than the communication tubes 52*a*, 52*b* are directed downward as separating away from the atmosphere communication ports 72. However, the upstream-side communication tubes may be located at the same position as or at the lower position than the sub-tanks 51*a*, 51*b*. Also, the downstream-side communication tubes may have arbitrary shapes.

Further, in the above illustrative embodiment, the lower ends of the communication tubes 56*a*, 56*b* are located below the sub-tanks 51*a*, 51*b*. However, the lower ends of the communication tubes may be located at the same as or higher height than the sub-tanks 51*a*, 51*b*.

Further, in the above illustrative embodiment, the atmosphere communication flow path has the buffer tank 54 including the sponge 75. However, the sponge 75 may not be provided in the buffer tank 54 or the atmosphere communication flow path may not have the buffer tank 54.

Further, in the above illustrative embodiment, when the upper housing 1*a* is provided at the close position, the upstream port and downstream port of the buffer tank 54 are located above than the sponge 75. However, the upstream port and downstream port may be disposed at any positions with respect to the sponge 75.

The present invention can be applied to any of the line type and the serial type inkjet printer. Also, the present invention can be applied to a facsimile, a copier and the like as well as the printer. Further, the present invention can be applied to a recording apparatus which performs recording by ejecting liquid, other than the ink.

What is claimed is:

1. A liquid ejection apparatus comprising:

a support unit configured to support a recording medium;

a recording unit which has a ejection port for ejecting liquid to record an image on the recording medium supported on the support unit;

a tank including a liquid storage chamber configured to store liquid to be supplied to the recording unit, and an atmosphere communication port configured to allow the liquid storage chamber and atmosphere to communicate with each other;

a liquid-level sensor configured to detect a liquid level of liquid stored in the liquid storage chamber;

a storage amount control unit configured to control a liquid storage amount in the liquid storage chamber to be a predetermined maximum amount based on detection of the liquid-level sensor;

a first housing configured to hold the support unit; and a second housing configured to hold the recording unit and the tank, the second housing being configured to be rotatable about a predetermined axis line with respect to the first housing to be moved between a close position where the recording unit comes close to the first housing and faces the support unit and a separate position where the recording unit is separated from the first housing than the close position, wherein an upper surface of the liquid storage chamber includes two regions divided by a first imaginary plane to have a same area, the first imaginary plane being parallel with the predetermined axis line and intersecting with the upper surface, and wherein the atmosphere communication port is provided in a region of the two regions, which is away from the predetermined axis line and in an area which the liquid stored in the liquid storage chamber does not reach when the first housing is rotated from the close position about the predetermined axis line by a maximum amount in a state in which the liquid storage amount in the liquid storage chamber is maintained as the predetermined maximum amount.

2. The liquid ejection apparatus according to claim 1, wherein the tank is connected with an atmosphere communication flow path configured to allow the liquid storage chamber and the atmosphere to communicate with each other via the atmosphere communication port.

3. The liquid ejection apparatus according to claim 2, wherein a flow path sectional area of the atmosphere communication flow path at a first position is larger than a flow path sectional area at a second position downstream from the first position.

4. The liquid ejection apparatus according to claim 2, wherein the atmosphere communication flow path is bent.

5. The liquid ejection apparatus according to claim 4, wherein the atmosphere communication flow path has a part which extends in a direction coming close to the predetermined axis line to have a component orthogonal to the predetermined axis line as separating from the atmosphere communication port.

6. The liquid ejection apparatus according to claim 4, wherein the region in the upper surface, which includes the atmosphere communication port, includes two sections divided by a second imaginary plane to have same area, the second imaginary plane being orthogonal to the predetermined axis line and passing a center of the liquid storage chamber in a direction parallel with the predetermined axis line, wherein the atmosphere communication port is located in one of the two sections, and wherein the atmosphere communication flow path has a part which extends from the one of the sections toward the other of the sections to have a component parallel with the predetermined axis line as separating from the atmosphere communication port.

7. The liquid ejection apparatus according to claim 4, wherein the atmosphere communication flow path includes a first part which is located above the tank and a second part which is directed downward as separating away from the atmosphere communication port at a more downstream side than the first part when the second housing is provided at the close position.

8. The liquid ejection apparatus according to claim 7, wherein a downstream end of the second part is provided below the tank when the second housing is provided at the close position.

9. The liquid ejection apparatus according to claim 8, wherein the first part includes a liquid holding chamber having a flow path sectional area larger than a surrounding area of the atmosphere communication flow path, the liquid holding chamber includes an upstream port and a downstream port which configure a part of the atmosphere communication flow path, and the liquid holding chamber accommodates therein an absorption member capable of holding the liquid, when the second housing is provided at the close position.

10. The liquid ejection apparatus according to claim 9, wherein the upstream port and the downstream port are located above the absorption member when the second housing is provided at the close position.

11. The liquid ejection apparatus according to claim 10, wherein the upstream port is located above the downstream port when the second housing is provided at the close position.

12. The liquid ejection apparatus according to claim 9, wherein a flow path sectional area of the atmosphere communication flow path at an upstream side of the liquid holding chamber is greater than a flow path sectional area at a downstream side of the liquid holding chamber.

* * * * *